US006702615B1

(12) United States Patent
Fan

(10) Patent No.: US 6,702,615 B1
(45) Date of Patent: Mar. 9, 2004

(54) ELECTRICAL CONNECTOR WITH SHELL

(75) Inventor: Chia Hao Fan, Tu-chen (TW)

(73) Assignee: Hon, Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 10/328,545

(22) Filed: Dec. 23, 2002

(51) Int. Cl.[7] ..... H01R 13/648
(52) U.S. Cl. ..... 439/607
(58) Field of Search ..... 439/567, 570, 439/607, 608, 609, 610

(56) References Cited

U.S. PATENT DOCUMENTS 5,356,313 A * 10/1994 Niwa et al. ..... 439/607
5,591,036 A * 1/1997 Doi et al. ..... 439/79
5,709,556 A * 1/1998 Tan et al. ..... 439/79
5,820,393 A * 10/1998 Edgley et al. ..... 439/181
6,056,560 A 5/2000 Wu et al.
6,065,979 A * 5/2000 Lai et al. ..... 439/79
6,093,046 A 7/2000 Chiou et al.
6,146,201 A * 11/2000 Chen ..... 439/607
6,210,218 B1 * 4/2001 Chang ..... 439/567
6,238,219 B1 5/2001 Wu

* cited by examiner

*Primary Examiner*—Javaid H. Nasri
*Assistant Examiner*—Thanh-Tam Le
(74) *Attorney, Agent, or Firm*—Wei Te Chung

(57) ABSTRACT

An electrical connector (1) for being mounted onto a printed circuit board includes an insulative housing (2), a number of conductive terminals (3) retained in the housing, a metal shell (4) mounted on the insulative housing, a number of separated grounding tabs (5) and a spacer (6). The shell has two resiliently mating pieces (44) extending downwardly and sidewardly from opposite ends thereof. Each grounding tab has a main body (50), and a soldering portion (503). When the shell is assembled to the housing, the mating pieces of the shell abut against the main bodies of the grounding tabs and the soldering portions of the grounding tab electrically connect with grounding traces of the printed circuit board.

1 Claim, 3 Drawing Sheets

ELECTRICAL CONNECTOR WITH SHELL

CROSS-REFERENCES TO RELATED APPLICATIONS

This application is related to a contemporaneously filed U.S. patent application Ser. No. 10/328,954 filed on Dec. 23, 2002 and entitled "ELECTRICAL CONNECTOR WITH SPACER", which is invented by the same inventor and assigned to the same assignee as this application and which is hereby fully incorporated by reference.

BACKGROUND OF THE INVENTION

1. Field of the Invention

The present invention is related to an electrical connector, and more particularly to an electrical connector having a shell for providing Electro Magnetic Interference (EMI) shielding.

2. Description of Related Art

It is known that, when connectors are used in high speed data transmission applications, electromagnetic or radio frequency interference is significant. Electrical connectors, as shown in U.S. Pat. Nos. 6,093,046 and 6,238,219, are usually provided with shells to be protected against EMI. The shells of U.S. Pat. Nos. 6,093,046 and 6,238,219 are generally in a rectangular box-like form and each comprises a body portion and a pair of opposite sidewalls extending from the body portion and completely covering side walls of corresponding housing. Each sidewall of the shell has a grounding tab integrally extending therefrom for electrical connection with a grounding trace of a printed circuit board to which the electrical connector is mounted. However, the sidewalls of shells covering the whole sidewalls of the housing needs relatively more material, and in turn increases manufacturing cost of the connector. Furthermore, the rectangular box-like shell with grounding tabs extending therefrom requires that the insulative housing and the shell have a very stringent corresponding configurations to match with each other, thereby increasing the difficulty in assembling the electrical connector.

Hence, it is requisite to provide an improved electrical connector to overcome the above-mentioned disadvantages.

SUMMARY OF THE INVENTION

Accordingly, an object of the present invention is to provide an electrical connector with a shell easily assembled thereto and saving the cost thereof.

In order to achieve the object set forth, an electrical connector for being mounted onto a printed circuit board in accordance with the present invention comprises an insulative housing, a plurality of conductive terminals retained in the insulative housing, a metal shell mounted on the insulative housing, a plurality of grounding tabs and a spacer. The shell comprises a pair of collars each defined by a downward extending peripheral wall, three engaging members and four clasping tabs formed in each side wall of the two collars, two side caps respectively connected to two distal ends of the two collars for covering the mating face of the housing and a shielding slot defined together by opposite collars and opposite side caps. A pair of mating pieces extend sidewardly and downwardly from each side cap and each has a resilient free end. Each grounding tab has a planar main body, an intermediate portion extending downwardly from the main body and a soldering portion extending downwardly from a middle of the intermediate portion. When the shell is assembled to the housing, the mating pieces of the shell abut against the main bodies of the grounding tabs and the soldering portions electrically connect with grounding traces of the printed circuit board.

Other objects, advantages and novel features of the invention will become more apparent from the following detailed description of the present embodiment when taken in conjunction with the accompanying drawings.

DETAILED DESCRIPTION OF THE PREFERRED EMBODIMENT

Figure 1:
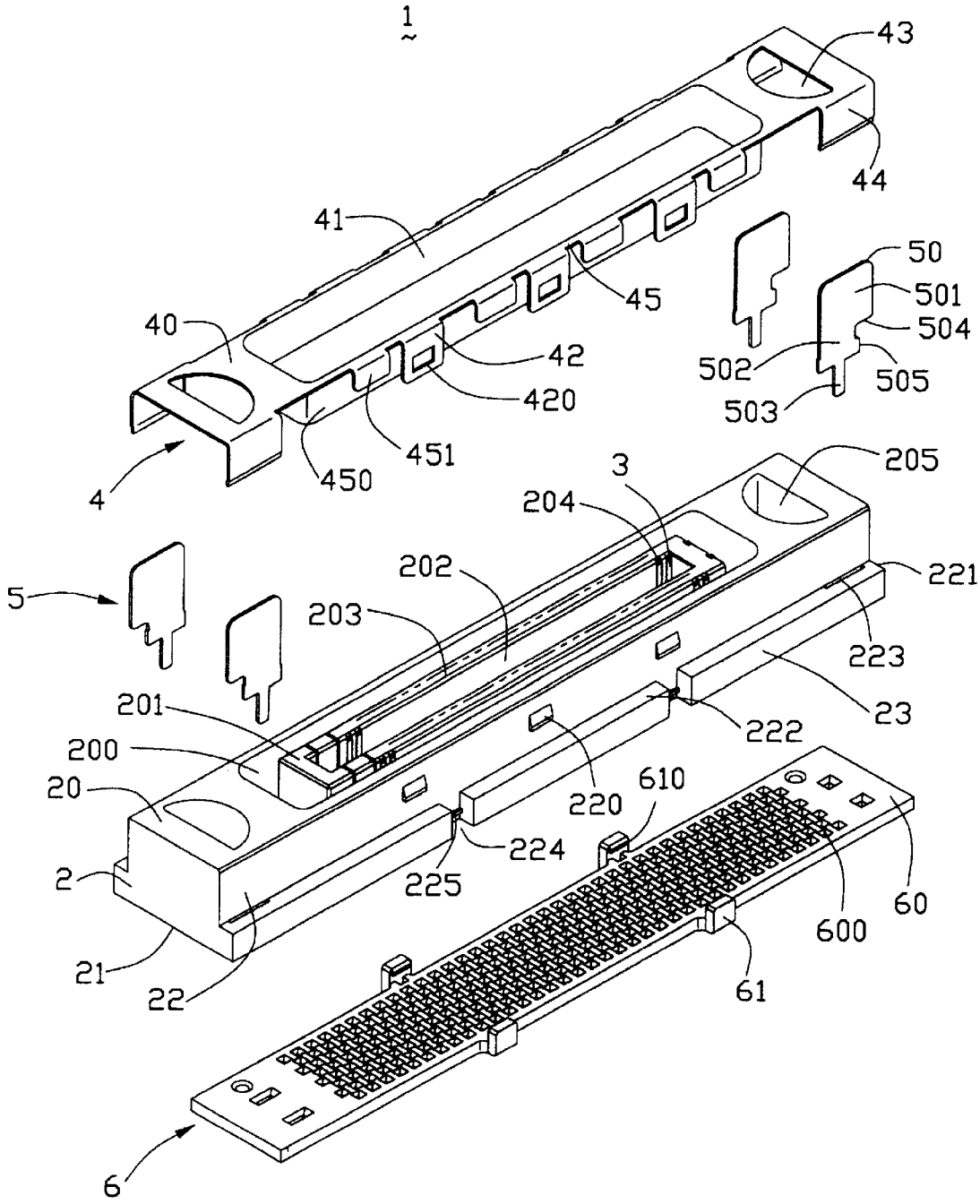
FIG. 1 is an exploded perspective view of an electrical connector in accordance with the present invention.
Figure 2:
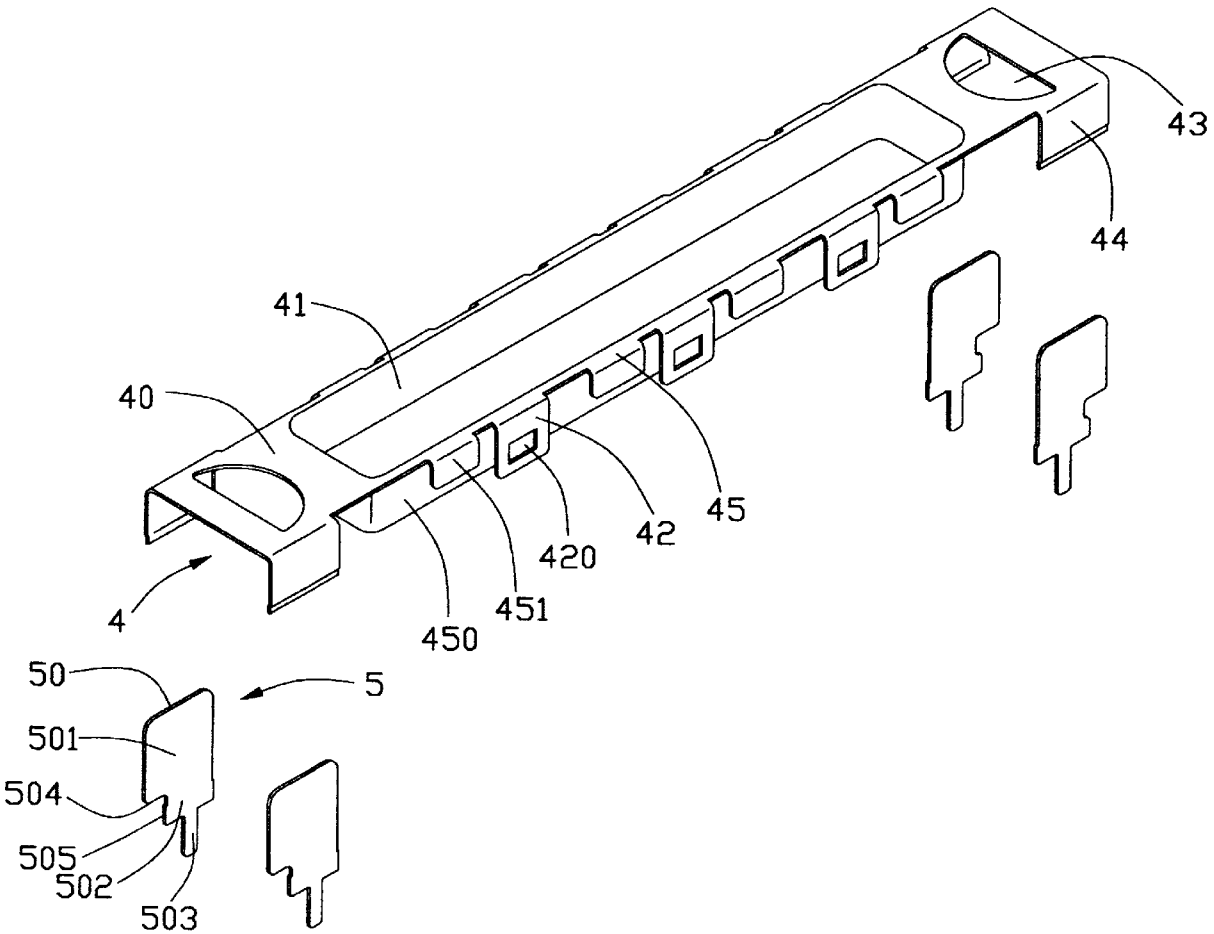
FIG. 2 is a perspective view of a shell and a plurality of grounding tabs of the electrical connector of FIG. 1.
Figure 3:
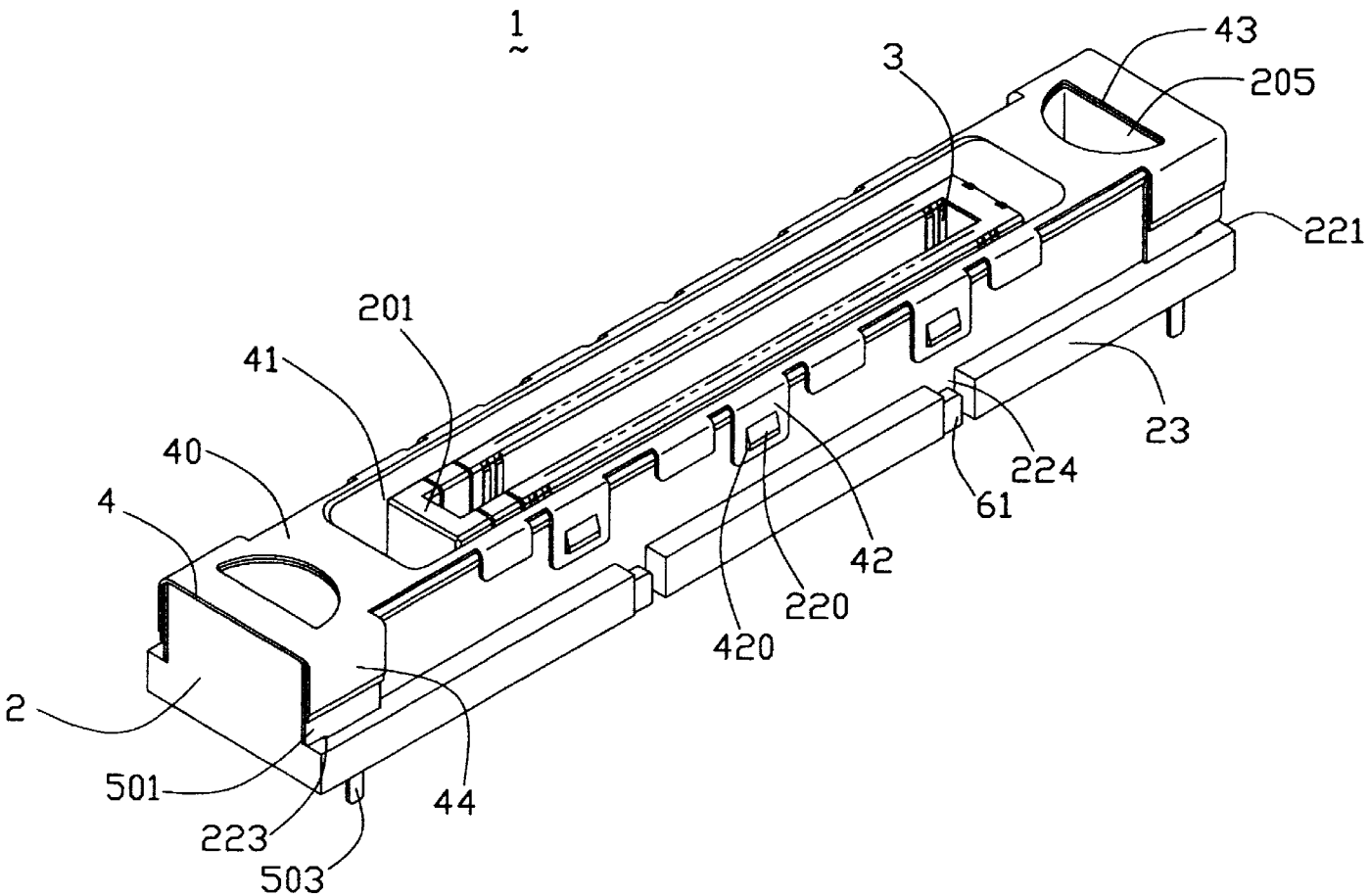
FIG. 3 is an assembled view of the electrical connector of FIG. 1.

Referring to FIGS. 1 and 2, an electrical connector 1 in accordance with the present invention comprises an insulative housing 2, a plurality of conductive terminals 3 retained in the housing 2, a metal shell 4 mounted on the insulative housing 2, a plurality of grounding tabs 5 and a spacer 6.

The insulative housing 2 has an elongated configuration. The insulative housing 2 has a mating face 20 on the top thereof, an engaging face 21 opposite to the mating face 20, and opposite side faces 22 extending between the mating face 20 and the engaging face 21. The housing 2 comprises a mating cavity 200 extending from the mating face 20 to the engaging face 21. A mating tongue 201 extends in the mating cavity 200. The mating tongue 201 has opposite sidewalls 203 and a central slot 202 between the sidewalls 203. Each sidewall defines a plurality of passageways 204 extending from the mating face 20 to the engaging face 21. A pair of guiding holes 205 are defined in opposite ends of the housing 2. A plurality of tapered protrusions 220 adjacent to the mating face 20 are formed on the opposite sidefaces 22 of the housing 2. A pair of blocks 222 project outwardly from middle portions of opposite sidefaces of the housing 2 and are located adjacent to the engaging face 21. A pair of supporting sections 23 are formed on each side face 22 of the housing 2 and are located at two sides of corresponding block 222. A pair of cutouts 224 are defined between the block 222 and the supporting sections 23 on each side face 22. A retentive rib 225 extends between the block 222 and the supporting sections 23 and into the cutout 224. The supporting section 23 has a slit 223 vertically extending therethrough adjacent to one end of the housing 2.

The shell 4 is made of a metal sheet via punching and bending, and is attached to the insulative housing 2 for providing electromagnetic shielding. The shell 4 comprises a pair of collars 45 each defined by a downward extending peripheral wall 450, three engaging members 42 and four clasping tabs 451 formed in each side wall of the two collars 45, two side caps 40 respectively connected to two distal ends of the two collars 45 for covering the mating face 20 of the housing 20 and a shielding slot 41 defined together by opposite collars 45 and opposite side caps 40. Each engaging member 42 defines a clasping hole 420 for securing to the corresponding tapered protrusions 220 of the housing 2. Each of the side caps 40 defines a guiding hole 43 for communication with corresponding hole 205 of the housing 2. A pair of mating pieces 44 extend sidewardly and downwardly from each side cap 40 and each has a resilient free end.

Each grounding tab 5 has a planar main body 50, an intermediate portion 502 extending downwardly from the main body 50 and a soldering portion 503 extending downwardly from a middle of the intermediate portion 502. The main body 50 has an outer flat face 501 and a lower edge 504. The intermediate portion 502 has a pair of barbs 505 extending outwardly from opposite sides thereof. A width of the intermediate portion 502 is less than that of the main body 50, and larger than that of the soldering portion 503.

Referring to FIG. 1, the spacer 6 has an elongated plate 60. The elongated plate 60 defines a plurality of receiving holes 600 for positioning tails (not shown) of the terminals 3 to extend therethrough. A pair of latches 61 extend upwardly from each of opposite sides of the plate 60 and each latch 61 has a hook 610 at a free end thereof.

In assembly, the terminals 3 are inserted into the passageways 204 of the housing 2, and the grounding tabs 5 are inserted into the slits 223 of the supporting sections 23 with the lower edges 504 thereof abutting against top faces of corresponding supporting sections 23. The barbs 505 of the grounding tabs 5 interferentially engage with inner walls (not shown) of the slit 223 for securing the grounding tab 5 in the slit 223. The soldering portion 503 of the grounding tab 5 extends beyond the engaging face 21 of the housing 2 for being electrically connected with a grounding trace of a printed circuit board (not shown).

The shell 4 is assembled onto the housing 2 from a top aspect and the peripheral wall 450 of the shell 4 are received in the mating cavity 200 of the housing 2 with the clasping holes 420 engaging with the protrusions 220 of the housing 2, the clasping tab 451 of the shell 4 clasps the sidefaces 22 of the housing 2. The mating pieces 44 of the shell 4 overlap the grounding tabs 5, and inner faces (not labeled) of the mating pieces 44 abut resiliently against the outer faces 501 of the grounding tabs 5 for achieving electrical and mechanical connection therebetween. The spacer 6 is assembled to the housing 2 from a bottom aspect, the latches 61 are received in the cutouts 224 and the hooks 610 of the latches 61 engage with the ribs 225 of the housing 2.

The shell 4 and the grounding tabs 5 are separatedly mounted to the and decrease the difficulty of assembling the electrical connector. The does not cover all sidewalls of the housing 2 and so decreases the manufacturing cost of the shell.

It is to be understood, however, that even though numerous characteristics and advantages of the present invention have been set forth in the forgoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. An electrical connector for mounting to a printed circuit board, comprising:

an elongated insulative housing defining an upward facing mating face and an upright mating port extending therethrough, a pair of blocks projecting outwardly from middle portions of opposite side faces of the housing and located adjacent to an engaging face, a pair of supporting sections formed on each of said side faces and located at two sides of a corresponding block, a pair of cutouts defined between the pair of blocks and the supporting sections, a pair of retentive ribs extending between the blocks and the supporting sections and into the cutouts, the pair of supporting sections each having a slit vertically extending therethrough adjacent to one end of the housing;

a plurality of contacts disposed in the housing;

one piece metallic shell seated upon and covering said mating face except said mating port, the shell comprising a pair of collars each defined by a downward extending peripheral wall, a plurality of locking tabs formed in each side wall of the pair of collars, a pair of side caps respective connected to two distal ends of the pair of collars for covering the mating face of the insulative housing and a shielding slot defined between the pair of collars and between the pair of side caps, a pair of mating pieces extending sidewardly and downwardly form each of said side caps, each of said mating pieces having a resilient free end, no portions of the shell extending downwardly to cover an entire height of all side walls of the insulative housing;

at least one grounding tab attached to the insulative housing and having a lower portion extending downwardly for engagement with the printed circuit board, the grounding tab inserted into a corresponding one of the slits with a lower edge abutting against a top face of a corresponding supporting sections, a pair of barbs interferentially engaging with inner walls of the corresponding one of said slits, one of the mating pieces of the shell overlapping an upper portion of the grounding tab, and an inner face of the mating piece abutting resiliently against an outer flat face of the grounding tab for achieving electrical and mechanical connection therebetween; and a spacer having a plurality of positioning holes for allowing the terminals to extend therethrough, wherein the spacer has a pair of latches received in the cutouts and each of said latches has a hook engaging with the corresponding one of said ribs of the housing.

* * * * *